United States Patent [19]

Zimmerman

[11] Patent Number: 4,877,163

[45] Date of Patent: Oct. 31, 1989

[54] GARMENT HANGER ACCESSORY

[76] Inventor: Karen M. Zimmerman, 1949 Woodhaven Dr., Fort Wayne, Ind. 46819-1053

[21] Appl. No.: 225,025

[22] Filed: Jul. 26, 1988

[51] Int. Cl.[4] ..... A47G 25/48

[52] U.S. Cl. ..... 223/93; 24/301; D6/328

[58] Field of Search ..... 223/85, 91, 93; 24/508, 24/301, 510; D32/61, 62, 64; D6/328

[56] References Cited

U.S. PATENT DOCUMENTS

| | | | |
|---|---|---|---|
| 1,250,264 | 12/1917 | Zierold | 24/508 |
| 1,417,129 | 5/1922 | Armstrong | 24/508 |
| 1,525,734 | 2/1925 | Hassen | 223/93 |
| 1,716,985 | 6/1929 | Spear | 223/93 |
| 1,768,005 | 6/1930 | Schwartzman | 223/93 X |
| 1,991,987 | 2/1935 | Smith | 223/91 |
| 2,657,844 | 11/1953 | Weiss | 223/93 |
| 2,666,240 | 1/1954 | Maccaferri | 24/508 X |
| 2,723,064 | 11/1955 | Richards | 223/93 |
| 2,849,168 | 8/1958 | Boyer | 223/91 |
| 4,682,424 | 7/1987 | Irving | 223/93 X |

FOREIGN PATENT DOCUMENTS

| | | | |
|---|---|---|---|
| 454285 | 1/1928 | Fed. Rep. of Germany | 223/93 |
| 626315 | 5/1927 | France | 223/85 |
| 2128474 | 5/1984 | United Kingdom | 223/85 |

*Primary Examiner*—Robert R. Mackey
*Attorney, Agent, or Firm*—Barnes & Thornburg

[57] ABSTRACT

A detachable accessory device for a garment hanger has a fastening element, such as a clip, for fastening to a portion of a garment, and a flexible element for attaching the fastening element to the garment hanger such that the fastening element is movably attached to, but spaced apart from, the garment hanger. In the preferred embodiment of the invention, a pair of clips are connected to respective ends of a pair of elastic elements. The other ends of each of the elastic elements are connected to a ring which is suitable for connection to a garment hanger by, for example, placement over the body of the garment hanger hook. The clips are secured to portions of a garment to secure the garment in proper position and alignment on the hanger. The accessory device may be detachably attached to the garment hanger or, alternatively, be integrally formed with, or permanently attached to, the hanger assembly. In a preferred embodiment, the clips are provided with rounded edges and coverings to avoid snagging or other damage to garments or other adjacent items.

7 Claims, 1 Drawing Sheet

GARMENT HANGER ACCESSORY

BACKGROUND AND SUMMARY OF THE INVENTION

The present invention relates generally to a garment hanger, and more specifically to a modification of or accessory for a garment hanger which is intended to aid in securing a garment to the hanger and assuring proper alignment of a garment on the hanger.

Blouses and other garments having heavily padded shoulders are currently fashionable items. However, it is difficult to keep these garments secured to existing hangers. The shoulder pads are bulky and somewhat cumbersome and do not balance well on existing hangers. There is a tendency for the pads to slip off the hangers causing misalignment of the garment, and causing the garment to wrinkle.

An object of the present invention is to provide a hanger which will secure such garments to the hanger and which will provide proper alignment of the garment on the hanger.

Another object of the present invention is to provide a hanger which will secure padded blouses to the hanger without snagging the garment or leaving any marks on the garment.

Yet another object of the present invention is to provide a garment hanger which is aesthetically pleasing in appearance.

These and other objects are attained in a garment hanger accessory comprising fastening means, for releasbly fastening a portion of a garment, and means for attaching the fastening means to the garment hanger. In a preferred embodiment, the means for attaching the fastening means to the garment hanger comprises a molded plastic ring which slides over the hook of an existing hanger, and strands of elastic material which are attached to the hook. This particular embodiment of the hanger assembly includes a plurality of molded plastic clips, which are spring operated and biased toward the closed position. The clips have opposing body elements, which are smooth and rounded at the opening end. At least a portion of both clips and the molded plastic ring are covered and hidden from view. The accompanying figures show an embodiment of the garment hanger accessory wherein the fastening means and plastic ring are at least partially covered with a cloth floral design and a bow.

Other objects, advantages and novel features of the present invention will become apparent from the following detailed description of a preferred embodiment of the invention, when considered in conjunction with the accompanying drawings.

DETAILED DESCRIPTION OF THE DRAWINGS

Figure 1:
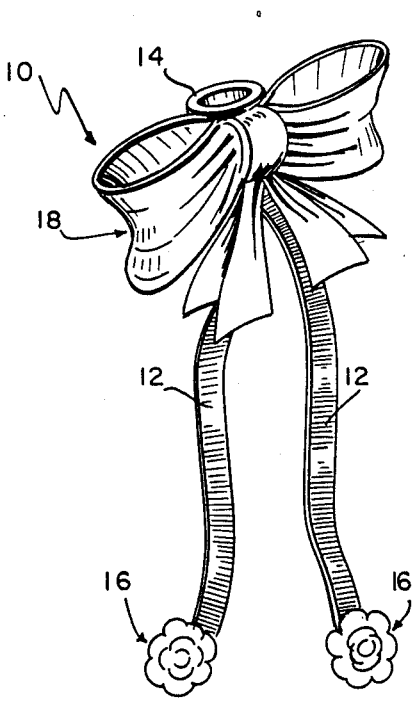
FIG. 1 shows a frontal view of one embodiment of an accessory device for a garment hanger constructed in accordance with the present invention.

FIG. 1 shows a frontal view of a garment hanger accessory device 10 constructed in accordance with the present invention. Device 10 comprises a pair of flexible, elastic elements 12 which are commonly connected at one end to a molded plastic ring 14. The inner diameter of ring 14 is sized so as to allow ring 14 to slide over and snugly fit around the wire or plastic hook of an otherwise conventional garment hanger. Attached to the opposite ends of flexible elements 12 are a pair of fastening elements, or clips, 16, which are described in additional detail in connection with FIGS. 4*a* and 4*b* below. Device 10 further comprises a cloth bow 18 which, as will be discussed below, is primarily intended to conceal plastic ring 14 from view when accessory device 10 is mounted on a garment hanger.

Figure 2:
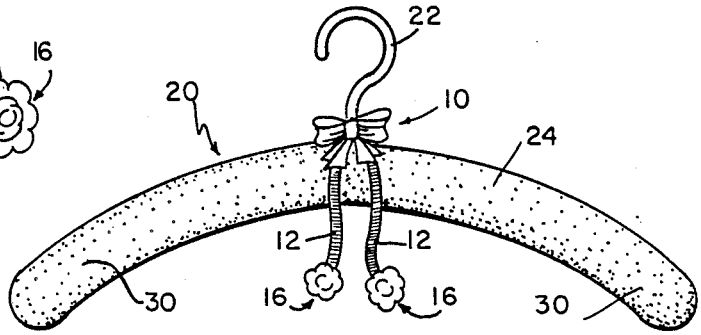
FIG. 2 shows the accessory device of FIG. 1 mounted on a garment hanger.

FIG. 2 shows a perspective view of accessory device 10, as mounted on a garment hanger 20. As noted, plastic ring 14 is designed to slip over hook 22 which is used to suspend hanger 20 from an overhead support. Device 10 can, of course, be secured to hanger 20 by other means which would be equally effective (for example, by direct attachment to body 24 of hanger 20). Alternatively, device 10 can be integrally formed with hook 22 or body 24, which would be tantamount to permanently mounting device 10 to hanger 20. Although this may be desirable in many applications, an advantage to the structure shown in FIG. 1 lies in the ease with which device 10 may be transferred from hanger to hanger as the need might arise. Both of these embodiments are considered to fall within the scope of the present invention, as defined in the appended claims.

Referring again to FIG. 2, clips 16 are shown suspended from flexible elements 12, which are preferably formed of strips of elastic material. In the "relaxed" position shown in FIG. 2, the elastic material of elements 12 support clips 16 at a position which is closer to hook 22 than would otherwise be the case if non-elastic materials were used to form elements 12. This has the advantage of reducing the tendency of clips 16 to become entangled with or caught on surrounding objects (such as adjacent hangers and clips), as well as improving the overall appearance of the device and hanger. As illustrated in FIG. 2, clips 16 are covered with fabric in a floral design both for decorative purposes and for the purpose of preventing the clips from snagging or scraping the material of an overlying garment, or other adjacent article. The specific design of clips 16 is discussed more fully below in connection with FIGS. 4*a* and 4*b*.

Figure 3:
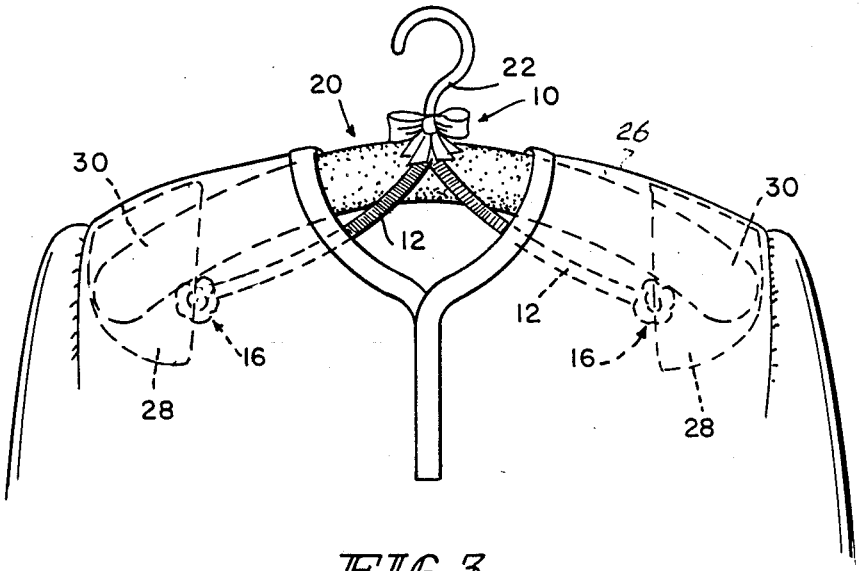
FIG. 3 shows the accessory device of FIGS. 1 and 2 as used to maintain a garment in place on the hanger.

FIG. 3 shows another view of accessory device 10 and hanger 20 of FIG. 2, as used to support a garment 26. Garment 26 is designed to incorporate shoulder pads 28 which are positioned over the outer ends 30 of body 24 of garment hanger 20. As shown in FIG. 3, clips 16 are fastened to shoulder pads 28 so as to retain pads 28 in position on the body of the hanger. In the preferred embodiment, the elastic of flexible elements 12 is relatively "weak" so as to exert very little force on shoulder pads 28 to avoid a tendency to pull pads 28 (and possibly overlying garment 26) inwardly toward the center of hanger 20. If, on the other hand, such an inwardly directed force is desirable for particular applications, a relatively "strong" elastic material may be used to form flexible elements 12. It should also be noted that clips 16 are specifically designed to avoid exerting unnecessary force on the respective points of attachment of each clip to pads 28. This feature is discussed more fully below in connection with FIGS. 4*a* and 4*b*.

Figure 4A:
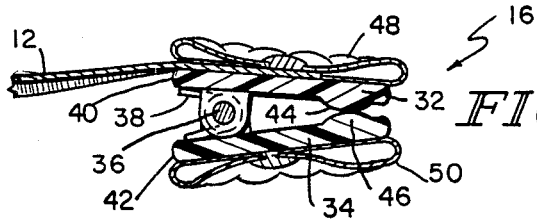
FIGS. 4*a* and 4*b* show enlarged side views of a fastening element which may be used with the accessory device of FIG. 1.
Figure 4B:
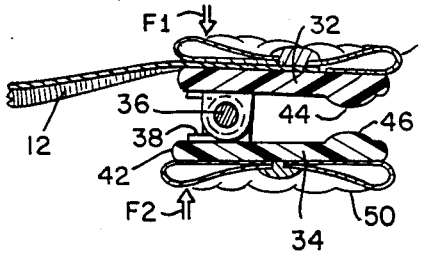

FIGS. 4*a* and 4*b* show enlarged, detailed views of a clip 16 of the type which is suitable for use with the present invention. Clip 16 comprises two opposing body members 32 and 34 which are connected to each other at a central pivot point 36. Coil spring 38 is mounted and positioned around pivot point 36 so as to exert an outwardly directed force against the interior surfaces of ends 40 and 42 of opposing body members 32 and 34, respectively. This causes clip 16 to assume the normally closed position shown in FIG. 4*a*. To open the clip, forces F1 and F2 are applied to ends 40 and 42 of clip 16, as illustrated in FIG. 4*b*.

As illustrated, the corners of opposing body members 32 and 34 are smooth and rounded to preclude tearing, snagging, or scraping of the overlying garment or other adjacent items. The points of contact between opposing body members 32 and 34 (i.e., the actual gripping surfaces) are also preferably smooth and rounded, as illustrated at 44 and 46, to avoid an excessive concentration of force at the point of attachment of clip 16 to shoulder pads 28, or other applicable portion of the overlying garment. Alternatively, if a more concentrated gripping force is desired, pointed, grooved, or otherwise non-smooth surfaces at points 44 and 46 could be employed.

Clip 16 of FIGS. 4*a* and 4*b* is also provided with decorative material 48 and 50 attached to respective exterior surfaces of opposing body members 32 and 34. Materials 48 and 50 may be attached to opposing body members 32 and 34 by, for example, adhesive. In addition to serving a decorative function, coverings 48 and 50 also serve to prevent the more rigid portions of clip 16 from potentially damaging contact with the overlying garment or other adjacent items.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A detachable accessory device for a garment hanger, comprising:

a plastic ring sized so as to slide over and snugly fit around a portion of the garment hanger;

a plurality of flexible, elastic elements commonly connected at first ends thereof to said plastic ring, each of said elastic elements having a second end;

a plurality of plastic fastening elements, each connected to the second end of one of said flexible, elastic elements, each of said fastening elements having a pair of opposing body elements movable between open and closed positions, and each of said body elements having an outwardly facing exterior surface; and decorative fabric means for covering substantially all of said outwardly facing exterior surfaces of the opposing body elements to shield said elements from view and to prevent unintended and potentially damaging contact with an overlying garment.

2. A detachable accessory device according to claim 1, wherein said opposing body elements are formed with smooth, rounded surfaces so as to further prevent damaging contact with and snagging of a garment.

3. A detachable accessory device according to claim 1, further comprising decorative fabric means for covering said plastic ring to shield said ring from view.

4. A garment hanger, comprising:

a body element for supporting a garment disposed thereon;

means for suspending said body element from a support;

a plurality of flexible, elastic elements commonly connected at first ends thereof to at least one of said body element and said means for suspending said body element from a support, each of said elastic elements having a second end;

a plurality of plastic fastening elements, each connected to the second end of one of said flexible, elastic elements, each of said fastening elements having a pair of opposing body elements movable between open and closed positions, and each of said body elements having an outwardly facing exterior surface; and decorative fabric means for covering substantially all of said outwardly facing exterior surfaces of the opposing body elements to shield said elements from view and to prevent unintended and potentially damaging contact with an overlying garment.

5. A garment hanger according to claim 4, wherein said opposing body elements are formed with smooth, rounded surfaces so as to further prevent damaging contact with and snagging of a garment.

6. A garment hanger according to claim 4, further comprising a plastic ring, integrally attached to one of said body element and said means for suspending said body element from a support, and wherein said first ends of said elastic elements are commonly connected to said plastic ring.

7. A garment hanger according to claim 6, further comprising decorative fabric means for covering said plastic ring to shield said ring from view.

* * * * *